United States Patent [19]

von Hoffman

[11] Patent Number: 4,775,182

[45] Date of Patent: Oct. 4, 1988

[54] FOLDABLE BEACH CHAIR OR THE LIKE

[76] Inventor: Brant von Hoffman, 1214 N. Curson Rd., Los Angeles, Calif. 90046

[21] Appl. No.: 106,426

[22] Filed: Oct. 9, 1987

[51] Int. Cl.[4] ..... A47C 4/28

[52] U.S. Cl. ..... 297/45; 297/350; 297/380

[58] Field of Search ..... 297/45, 44, 350, 357, 297/380

[56] References Cited

U.S. PATENT DOCUMENTS

| | | | |
|---|---|---|---|
| 1,196,731 | 8/1916 | Clark | 297/350 |
| 2,647,563 | 8/1955 | Bishop et al. | 297/350 |
| 3,136,272 | 6/1964 | Sprigman . | |
| 3,228,724 | 1/1966 | Resar | 297/45 |
| 3,730,584 | 5/1973 | Uchida | 297/45 |
| 4,014,591 | 3/1977 | Gittings . | |
| 4,047,752 | 9/1977 | Rohr . | |
| 4,258,951 | 3/1981 | Groom . | |
| 4,290,643 | 9/1981 | Logan . | |
| 4,487,345 | 12/1984 | Pierce et al. . | |
| 4,605,261 | 8/1986 | Lee . | |

*Primary Examiner*—Francis K. Zugel
*Attorney, Agent, or Firm*—Martha G. Pugh

[57] ABSTRACT

The chair of the present invention comprises a foldable frame of metal or other rigid material, comprising a fabric or plastic seat rest supported between a pair of tubes or rods, to the ends of which are hingedly connected a pair of telescoping tubular back supports, which, in open position extend upward, supporting between them in taut relation a backrest, also of fabric or plastic, which is further supported by a pair of X-pivoted braces and other braces connected to the telescoping tubular supports. Four stub legs support the seat rest in open position. A particular feature of the invention is that it is readily folded into an elongated configuration of narrow width, which may be fitted into a tube, by first folding the back and seat together, and telescopically extending the back supports, which simultaneously causes the X-pivoted braces and other braces to rotate into approximately parallel relation with the back supports.

8 Claims, 3 Drawing Sheets

FOLDABLE BEACH CHAIR OR THE LIKE

BACKGROUND OF THE INVENTION

This relates in general to foldable, or collapsible chairs, and more particulary, to foldable beach chairs.

Various types of folding chairs and stools are common in the prior art, which are designed to fold up into a rectangular structure, or which involve a complex folding mechanism which renders them heavy and of an inconvenient shape for carrying on foot, or by bicycle or motor bike.

It is, accordingly, the principal object of this invention to provide a foldable, or collapsible chair of improved design. A more particular object of the invention is to provide a collapsible or foldable chair which is light weight, readily foldable and readily set up to form a rigid structure capable of supporting an adult person in sitting position. Another object of the invention is to provide a chair which can be collapsed into a longitudinal configuration of limited cross-sectional dimension which readily fits into a tubular carrying case which can easily be carried by a pedestrian or a person riding a bicycle or motor bike.

These and other objects of the invention are attained in a simple folding chair of the present invention which comprises a frame of aluminum or other rigid material which supports fabric or plastic back and seat rests with their edges disposed between two pairs of supports which are hingedly connected. In open position with the seat substantially horizontal, the backrest comprises a pair of telescoping tubular supports at its opposite edges. The latter, which are telescopically compacted to their shortest legnths, are connected by a pair of X-pivoted braces which are held in open relation by a brace at the base comprising a pair of scissor-like blades, the inner ends of which are snapped together to form a linearly-extended bar, and the outer ends of which are pivoted to the lower ends of the X-pivoted braces. The seat portion, which in open position, is extended in a substantially horizontal plane which forms an angle of slightly greater than 90 degrees with the backrest, comprises a pair of tubular seat supports on opposite edges, which are held apart at the front end by a horizontally disposedy brace, similar to that at the base of the backrest, having scissor-like blades with their ends snapped together in linear relation, and their outer ends pivoted to the underside of the tubular seat supports.

Inasmuch as the chair is designed primarily for beach use, it is supported in the sand or on the ground by two pairs of short leg stumps which project downwardly from opposite ends of the tubular seat supports. It is contemplated that if a chair of conventional height is desired, separate tubular legs can be provided which fit over and have their upper ends locked into place on each of the short leg stumps.

Small chains connected on opposite sides between the tubular supports of the backrest and the seat rest provide stability when the chair is open.

In order to fold up the chair of the present invention to its carrying position, the backrest is first rotated forward to close it against the seat rest. The telescoping tubular supports on opposite edges of the backrest are extended longitudinally, causing the X-pivoted braces to collapse together approaching parallel relation. Simultaneously, the inner ends of the scissor-like base braces, adjacent the front and rear of the seat rest, are rotated apart pivotally, to assume positions approximately parallel to the collapsed X-pivoted braces. When this operation has been completed, the frame, including the fabric or plastic covering, will have been collapsed into a narrow elongated configuration, which, in the presently disclosed embodiment, will fit into a tubular carrying case about 6 inches in inner diameter and 22 inches long.

Because the folding chair of this invention can be collapsed to fit into a tube in the manner described, it is adapted for ease of carrying, on a motorcycle, or bicycle, or by a walker. At a desired sitting place on the beach, at a picnic or athletic event, it is readily set up to form a substantially rigid, confortable seat with backrest.

Other objects, features and advantages will be apparent to those skilled in the art after a detailed study of the specification hereinafter with reference to the attached drawings.

SHORT DESCRIPTION OF THE DRAWINGS

DETAILED DESCRIPTION OF THE INVENTION

Figure 1:
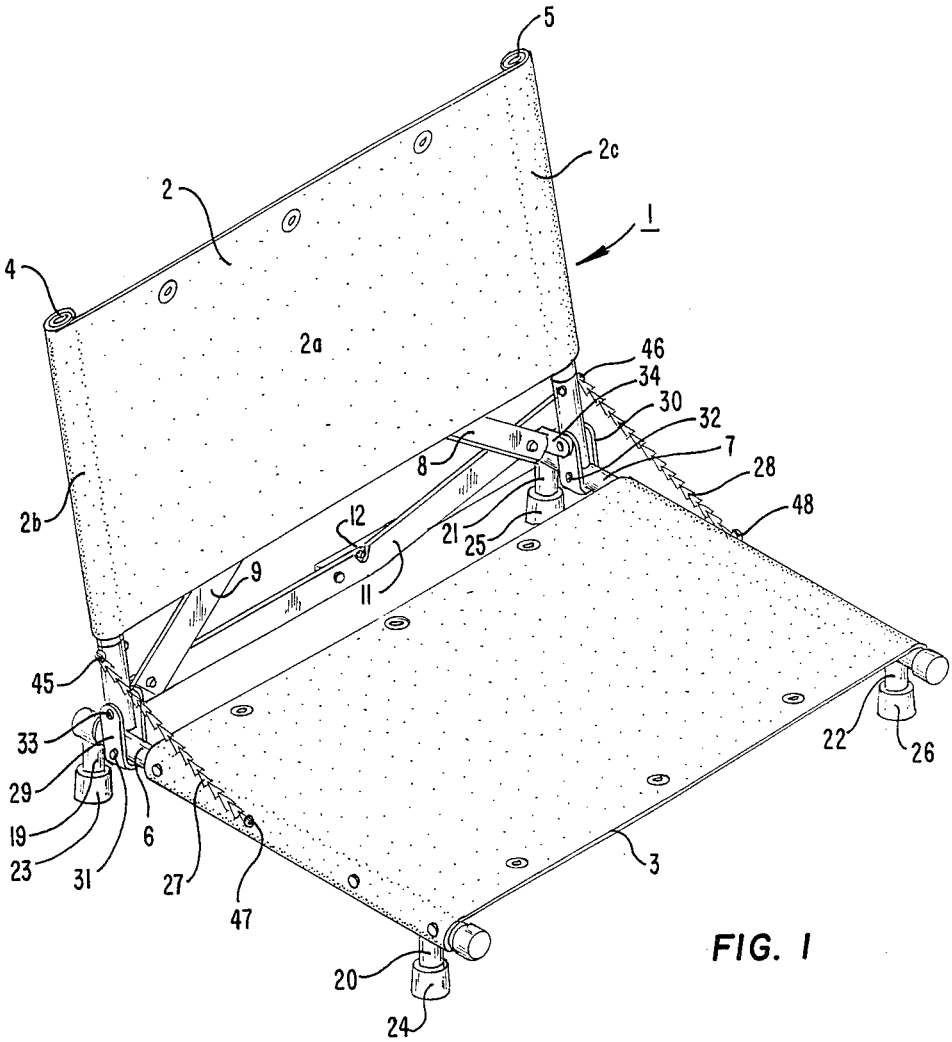
FIG. 1 is a front perspective view of the folding chair of my invention in open position, set up for use.

Referring to FIG. 1 of the drawings, there is shown the chair 1 of my invention, set up for use. The chair comprises a backrest 2 which is supported in pivotal relation to a seat rest 3. In preferred form, the frame of the chair is made of aluminum, although it will be understood that it can be made of any rigid material, which is also light weight, and has sufficient tensile strength to support an average adult in sitting position, and to withstand the folding and unfolding operations.

The backrest 2 comprises a cover 2a, which may comprise either fabric or plastic, such as, for example, a rectangular piece of canvas, or other rugged material, or any braided or woven composite having good wearing quality and strength. In the present example, the cover 2a is 23 inches long, and 13½ inches wide, and is formed at opposite lateral edges to provide a pair of sleeves 2b and 2c which have inner diameters just sufficient to accommodate the telescoping tubular back supports 4 and 5, of 1 inch outer diameter, to which the sleeves may be adhesively cemented or otherwise secured when the chair is assembled. The upper and lower edges of the fabric backrest 2a may be hemmed in conventional manner with hems approximately 1 inch wide, or may be sewn or otherwise secured, as with a series of metal grommets, spaced-apart. The structure of the telescoping back supports 4 and 5 will be described in more detail hereinafter with reference to FIGS. 7 and 8, which show telescoping tubular support 4 in diametrical section, in extended and collapsed positions (telescopoping tubular support 5 being substantially identical). The lower end 4c, 5c of telescoping tubular back supports which are each 1 inch in outer diameter and ⅞ inch in inner diameter, are respectively supported to rotate about pins 33 and 34, which are mounted between the legs of U-shaped straps 29 and 30, which partially surround and are fixed in place on the tubular seat supports 6 and 7, so that the latter rest in, and are rigidly supported in the nadirs of straps 29 and 30 by bolts 31 and 32. The bolts are interposed through the cross-sections of tubes 6 and 7, in positions centered about 1¾ inches in from their respective ends.

When the chair is open, and set up in rest position, the tubular seat supports 6 and 7, which in the embodiment under description, have outer diameters of 1 inch, and inner diameters of ⅞ inch, extend 16¼ inches in parallel relation, with their centers spaced-apart a distance of 17½ inches. Respectively centered about 1 inch in from the rear ends of tubular supports 6 and 7, are the tubular stub legs 19 and 21; and centered about 1½ inches in from the front ends of tubular supports 6 and 7, are tubular stub legs 20 and 22. The stub legs extend down about 2 inches in normal relation to the principal axes of the supports 6 and 7. The ends of stub legs 19, 20, 21 and 22, are respectively encased in rubber or synthetic rubber ferrules 23, 24, 25 and 26. The open ends of tubes 6 and 7 may be encased in similar rubber or synthetic rubber ferrules, 23, 24, 25 and 26.

The seat cover 3a comprises a piece of plastic or fabric, preferably similar to and matching the cover of backrest 2a. In the present example, the latter is a piece of canvas, about 23 inches long and 15 inches wide, which is provided at its opposite lateral edges with a pair of sleeves which just accommodate the tubular seat supports 6 and 7, of one inch outer diameter, to which they may be adhesively cemented or otherwise secured in place when the chair is assembled.

The chains 27 and 28 are fastened at their upper ends between screws or bolts located a few inches above the lower ends 4c, 5c, of respective telescoping tubular back supports 4 and 5, and to similar screws or bolts located on tubular seat supports 6 and 7, so that each of the chains is pulled taut when the chair is in open, sitting position, functioning to keep the backrest 2 from rotating backwards beyond a comfortable sitting position.

Figure 2:
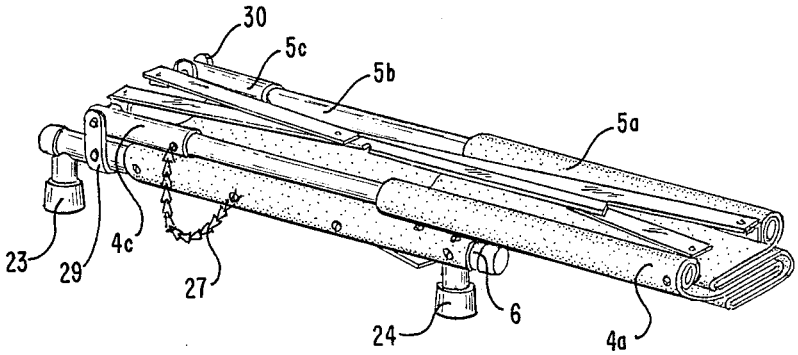
FIG. 2 is a top perspective view of the folding chair of my invention, collapsed, ready to be inserted into a tubular carrying case.

The mechanism will now be described for completely folding the chair into a longitudinal compact array, which, in the embodiment under description is approximately 6 inches in overall width and 22 inches in overall length, as illustrated in FIG. 2 of the drawings.

Figure 7:
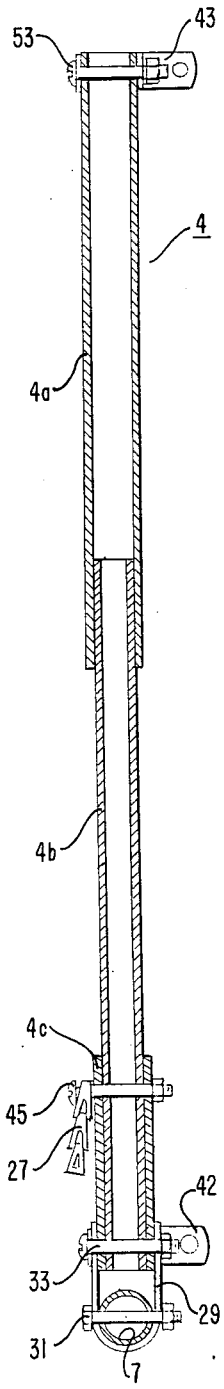
FIGS. 7 and 8 are longitudinal sectional views of one of the telescoping tubular back supports of the chair of my invention, in extended, and in telescopically compacted relation, respectively. The opposite telescoping tubular back support is substantially a mirror image to the one shown.
Figure 8:
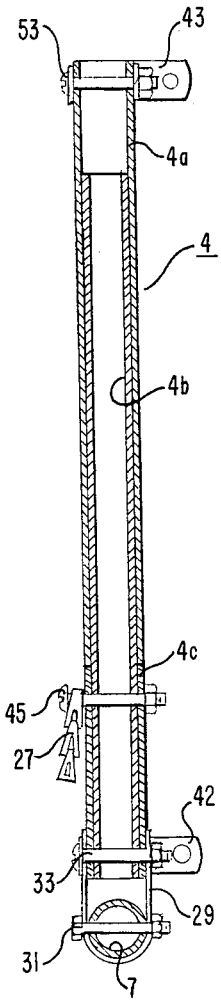

A salient feature of the folding mechanism is the construction of the telescoping tubular back supports 4 and 5, which is shown, in enlarged section in FIGS. 7 and 8.

Referring to FIG. 7, which shows telescoping tubular back support 4 in fully extended position, the base sleeve 4c comprises a tube 1 inch in outer diameter and ⅞ inch in inner diameter, and 3¾ inches in axial length, the end of which is mounted to move rotatably about the pin 33. The ends of pin 33 are rigidly supported between the legs of the U-shaped strap 29, being interposed diametrically through the cross-section of the tube 4c in a direction normal to the axis, a distance ½ inch from the lower end of tube 4c The tube 4b, which is ¾ inch in inner diameter, and ⅞ inch in outer diameter, and 1711/16 inches in axial length, is fixedly mounted in coaxial relation inside of base sleeve portion 4c, so that its lower end, which is penetrated transversely by the pin 33, is flush with the lower end of tube 4c.

Slideably mounted over, in telescoping relation to the upper end of tube 4b is a tube 4a, 1 inch in outer diameter, ⅞ inch in inner diameter, and 1010/16 inches in axial length. A flange 41, having an eyelet, is fastened to extend out laterally from the upper end of the tube 4a by a bolt 53 which passes diametrically through the tube 4a.

A laterally-extending flange 40, also having an eyelet, is similarly fastened to the lower end of base sleeve 4c. When the telescoping back support tube 4 is fully extended, in the present embodiment, it is 21½ inches long; and when it is telescopically compacted by tube 4a moving slideably downward against tube 4b, until the lower edge of 4a engages the upper edge of 4c, then the total axial length of the compacted combination is 14½ inches.

Referring now, to FIGS. 3, 4, 5 and 6, there are shown the rear, side, top and bottom elevational views of the chair frame, fully set up, but with the back and seat covers 2a and 3a removed. The X-pivoted braces 8 and 9 comprise substantially flat rectangular stiffening braces, each 21½ inches long, 1 inch wide, and ⅛ inch thick in the present embodiment. They are centrally pivoted on their flat surfaces to move rotatably about the pin 10 to either form a flat X, when completely open, or to collapse together, approaching parallel relation when closed. The upper end of brace 8 is connected by a pivot pin to eyelet 43 which is disposed to extend laterally-inward from telescoping arm 4a; whereas the lower end of 8 is connected by a pivot pin in eyelet 40, extending laterally-inward from the non-slideable tubular base 5c. Likewise, the upper end of brace 9 is connected by a pivot pin to eyelet 41, extending inward laterally from 5a whereas its lower end is connected by a pivot pin in eyelet 42 to the non-slideable tubular base 4c.

Figure 3:
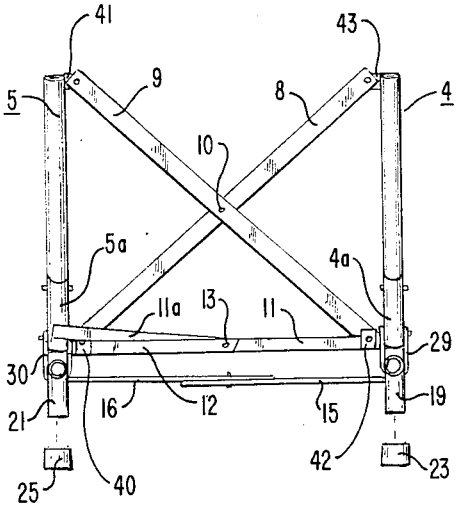
FIG. 3 is a rear elevational view of the frame, open for use, of the folding chair of my invention with the fabric cover removed.
Figure 4:
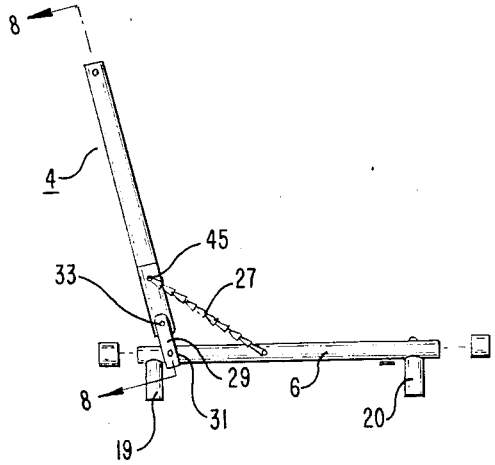
FIG. 4 is a side elevational view of the frame of the folding chair of my invention, open for use, with the fabric cover removed.
Figure 5:
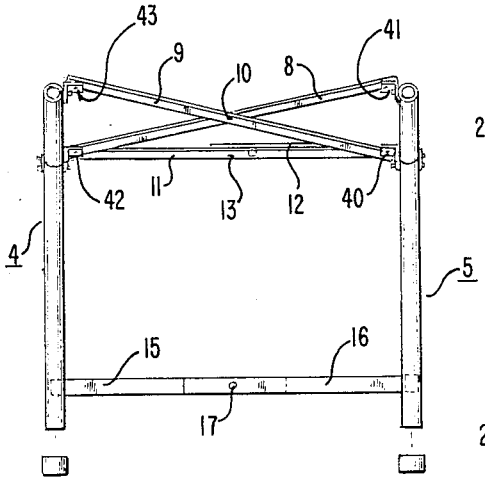
FIG. 5 is a view, looking down from the top of the frame, of the folding chair of my invention, open for use, with the fabric cover removed, and the back slightly angled backwards, for sitting position.

Referring to FIG. 3, lower back brace members 11 and 12, in open position of the chair, are disposed in substantially flat, colinear relation, with their flat sides substantially coplanar with the X-pivoted brace members 8 and 9. The back brace 11, which is a substantially rectangular strap, 1 inch wide and ⅛ inch thick, is pivotally connected at one end by the same pivot pin which extends through eyelet 42 to the lower end of X-pivoted brace member 9. Centered 8½ inches along brace 11 from the pivot point at eyelet 42 is a central pivot 13, by which it is rotatably connected to a supplemental brace 12, which is 8½ inches long, 1 inch wide and ⅛ inch thick. The free end 11a of brace member 11, which extends about 9 inches beyond the pivot point 13, forms an angle of about 5 degrees with the latter, its free end terminating adjacent to the telescoping tubular support 5. The other end of supplemental brace 12 is pivotally connected at a point 7¾ inches from pivot 13, through the lower end of X-pivoted brace member 8 to the eyelet 40 on the tubular base 5c.

Figure 6:
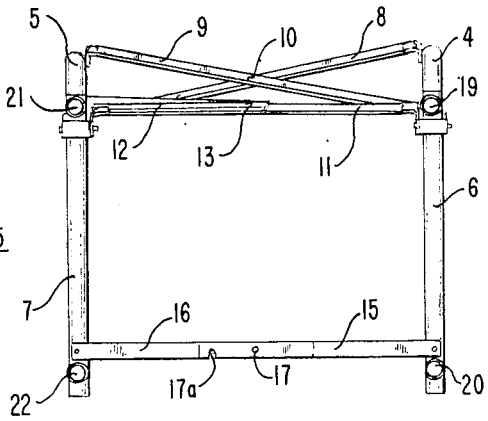
FIG. 6 is a view, looking up from the bottom of the frame, of the folding chair of my invention, open for use, with the fabric cover removed, and the back slightly angled backwards, for sitting position.

Across the front end beneath the seat, as shown in FIG. 6, is another pair of supporting braces 15 and 16, which are disposed with their flat sides in a plane parallel to the principal plane of the open seat. Brace 15, which is 12⅜ inches long, 1 inch wide and ⅛ inch thick, is pivotally connected to the under surface of tubular seat support 6 at a point 2½ inches from the forward end of the latter. Brace 16, which is 12¼ inches long, 1 inch wide, and ⅛ inch thick, is pivotally connected to the under surface of tubular seat support 7 at a point 2½ inches from the forward end of the latter.

The front braces 15 and 16 are interconnected at a pivot point 17. A small projection 17*a*, about 2¼ inches from the outer end of brace 15 is constructed to latch against a notch near the end of brace 16 to lock the two together when the seat is fully set up in open relation.

Figure 9:
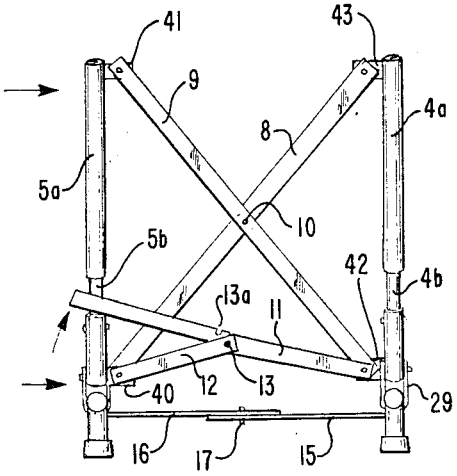
FIG. 9 is a rear elevational view of the frame in the process of being folded, of the folding chair of my invention with the fabric cover removed.
Figure 10:
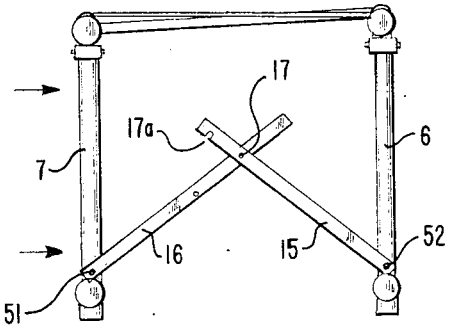
FIG. 10 is a view from the bottom of the frame, in the process of being folded, of the folding chair of my invention, with the fabric cover removed.
Figure 11:
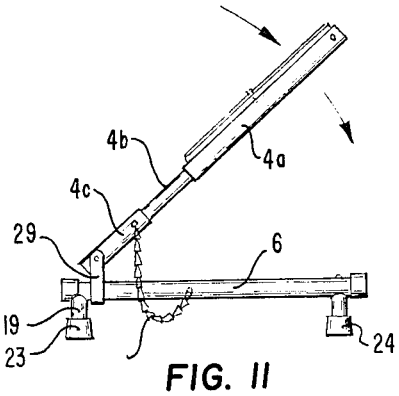
FIG. 11 is a side-elevational view of the frame, in the process of being folded, of the folding chair of my invention with the fabric cover removed.

Referring to FIGS. 9, 10, and 11, they show, respectively, the rear, bottom, and side of the chair frame during the folding process.

The first step in the collapsing process is to fold the back 2 into parallel relation with seat 3. The latch 17*a* is then unlocked, thereby releasing the front seat braces 16 and 17 to rotate pivotally in opposite directions. Pressure is then simultaneously exerted on the telescoping tubular back supports 4 and 5, so that 4*a* and 5*a* are caused to slide telescopically along the inner tubes 4*b* and 5*b*, respectively, thereby increasing the lengths of supports 4 and 5. As the X-crossed back braces 8 and 9 are moved together, approaching parallel relation, back brace 11–11*a* rotates clockwise about pivot point 42, and brace 12 rotates counterclockwise about pivot point 13. All of the members tend to move to approximately parallel relation with the extended telescoping tubular support 4 and 5. The seat and back covers 2*a* and 3*a* fold up between the coalescing frame members, so that the completely folded chair assumes the form shown in FIG. 2.

It will be understood that the entire assemblage can be inserted into a cylindrical tube to facilitate carrying, either on foot, or on a bicycle, motor or pedal operated. A particular advantage of the invention is that the assemblage, as folded, is only about one-third of the width of the chair when it is set up in fully open position.

It is also contemplated that if it is desired to have a chair of more conventional height, four tubular legs can be added to the assemblage, which can be readily bolted or screwed onto the leg stubs 19, 20, 21 and 22, as desired.

It will be understood that the invention is not limited to the particular form or dimensions disclosed herein by way of illustration, but only by the scope of the appended claims.

What I claim is:

1. A foldable chair or the like comprising in combination:

a flexible seat rest and a flexible backrest;

means comprising a foldable frame having a plurality of rigid members for supporing said seat rest and said backrest substantially taut and disposed in transversely related planes when said chair is set up in fully open position, and said frame being collapsible in closed relation into an elongated configuration substantially narrower than the width of said seat rest and backrest in said open position;

said frame including a pair of telescoping tubular members supporting between them the opposite lateral edges of said backrest, said telescoping tubular members each comprising a fixed tube and a slideable tube assembled in telescopically coalescing relation;

said backrest being further supported in open position by a pair of X-pivoted braces pivoted at a point substantially equidistant between their ends, wherein one end of each said X-pivoted braces is connected to the fixed tube of one of said telescoping tubular supports and the other end of each of said X-pivoted braces is connected to the slideable tube of the opposite one of said telescoping tubular supports;

said frame including a pair of rigid lateral seat supports for supporting between them the lateral edges of said seat rest, one end of each of said rigid lateral supports being hingedly connected to a respective one of the fixed tubes of said telescoping supports; and said frame including means for maintaining said seat rest above ground level.

2. The combination in accordance with claim 1 wherein said frame includes a pair of back braces, one end of each of the back braces of said pair respectively connected in pivotal relation to one of the fixed tubes of said telescoping tubular supports, said back braces being connected together in pivotal relation at a point substantially equidistant between said telescoping tubular supports, wherein when said chair is set up in fully open position, said braces are held together in substantially colinear relation, and wherein when said chair is collapsed, said braces rotate apart pivotally in opposite angular directions to assume positions transverse to said colinear position.

3. The combination in accordance with claim 1 which includes a pair of front braces, each of the braces of said pair pivotally connected at one end to a respective one of said rigid lateral seat supports, and the other ends of said front braces being pivotally joined at a point substantially equidistant between said rigid lateral supports, wherein when said chair is set up, in fully open position, said front braces are held together in substantially colinear relation, and wherein when said chair is collapsed, said front braces rotate apart pivotally in opposite angular directions to assume positions transverse to said colinear position.

4. The combination in ccordance with claim 1 wherein said rigid lateral seat supports are tubular.

5. The combination in accordance with claim 1 wherein said frame is collapsible into an elongated configuration having a width not exceeding about a third of the width of said seat rest in fully open position.

6. The combination in accordance with claim 1 wherein said means for maintaining said seat rest above ground level comprises four stub legs, two of which depend downwardly in rigid relation to each of said rigid seat supports.

7. The combination in accordance with claim 5 which includes a set of detachable legs constructed to be rigidly fastened to said stub legs.

8. 1. A foldable chair or the like comprising in combination:

a flexible seat rest and a flexible backrest;

means comprising a foldable frame having a plurality of rigid members for supporing said seat rest and said backrest substantially taut and disposed in transversely related planes when said chair is set up in fully open position, and said frame being collapsible in closed relation into an elongated configuration not exceeding about one third of the width of said seat rest and backrest in said open position;

said frame including a pair of telescoping tubular members supporting between them the opposite lateral edges of said backrest, said telescoping tubular members each comprising a fixed tube and a slideable tube assembled in telescopically coalescing relation;

said backrest being further supported in open position by a pair of X-pivoted braces of flat elongated configuration, pivotally connected on their flat faces at a point substantially equidistant between their ends, wherein one end of each said X-pivoted braces is connected to the fixed tube of one of said telescoping tubular supports and the other end of each of said X-pivoted braces is connected to the slideable tube of the opposite one of said telescoping tubular supports;

said frame including a pair of rigid tubular seat supports for supporting between them the lateral edges of said seat rest, one end of each of said rigid tubular seat supports being hingedly connected to a respective one of the fixed tubes of said telescoping supports;

two stub legs depending downwardly adjacent the opposite ends of each of said rigid tubular seat supports;

a pair of flat elongated back braces substantially coplanar with said X-pivoted braces, one end of each of the back braces of said pair respectively connected in pivotal relation to one of the fixed tubes of said telescoping tubular supports, said back braces being connected together in pivotal relation at a point substantially equidistant between said telescoping tubular supports, wherein when said chair is set up in fully open position, said braces are held together in substantially colinear relation, and wherein when said chair is collapsed, said braces rotate apart pivotally in opposite angular directions to assume positions transverse to said colinear position; and a pair of flat elongated front braces, each of the front braces of said pair pivotally connected on their flat faces at one end to a respective one of said rigid tubular seat supports, and the other ends of said front braces being pivotally joined on their flat faces at a point substantially equidistant between said rigid tubular seat supports, wherein when said chair is set up, in fully open position, said front braces are held together in substantially colinear relation, and wherein when said chair is collapsed, said braces rotate apart pivotally in opposite angular directions to assume positions transverse to said colinear position.

* * * * *